US007013921B2

(12) United States Patent
Bregoli

(10) Patent No.: US 7,013,921 B2
(45) Date of Patent: Mar. 21, 2006

(54) TAP FOR SINGLE HOLE KITCHEN SINKS

(75) Inventor: Elio Bregoli, Sarezzo (IT)

(73) Assignee: IB Rubinetterie S.p.A., Sarezzo (IT)

( * ) Notice: Subject to any disclaimer, the term of this patent is extended or adjusted under 35 U.S.C. 154(b) by 332 days.

(21) Appl. No.: 10/378,942

(22) Filed: Mar. 4, 2003

(65) Prior Publication Data

US 2003/0168110 A1 Sep. 11, 2003

(30) Foreign Application Priority Data

Mar. 5, 2002 (IT) ..... BS20020031 U

(51) Int. Cl.
*E03C 1/00* (2006.01)

(52) U.S. Cl. ..... 137/801; 4/678

(58) Field of Classification Search ..... 137/625.17, 137/625.4, 625.41, 801; 4/677, 678
See application file for complete search history.

(56) References Cited

U.S. PATENT DOCUMENTS

| | | | | |
|---|---|---|---|---|
| 3,202,181 | A * | 8/1965 | West | 137/625.17 |
| 3,378,034 | A * | 4/1968 | Andrews | 137/625.4 |
| 3,410,487 | A * | 11/1968 | Hyde | 137/625.17 |
| 3,653,407 | A * | 4/1972 | Katva | 137/625.17 |
| 4,262,699 | A * | 4/1981 | Fabian | 137/801 |
| 4,698,858 | A * | 10/1987 | Kostorz | 4/677 |
| 4,997,008 | A * | 3/1991 | Zbin | 137/801 |
| 6,321,788 | B1 * | 11/2001 | Egli | 137/801 |
| 6,328,067 | B1 * | 12/2001 | Hsiung | 137/801 |
| 6,394,133 | B1 * | 5/2002 | Knapp | 137/801 |

* cited by examiner

*Primary Examiner*—John Rivell
(74) *Attorney, Agent, or Firm*—Shoemaker and Mattare

(57) ABSTRACT

The present finding relates to a tap for single hole kitchen sinks comprising a top body (11) from which a water outlet (17) extends, arranged and turning on a bottom fixed and hollow body (12), wherein the water adjustment and mixing cartridge (16) is housed into a seat (15) obtained into the top turning body (11) at said water outlet and wherein the top body is integral with a union sleeve (21) inserted and rotating into the bottom fixed body.

11 Claims, 2 Drawing Sheets

TAP FOR SINGLE HOLE KITCHEN SINKS

BACKGROUND OF THE INVENTION

The present utility model relates to a tap for single hole kitchen sinks.

At present, single hole taps are realized by prearranging a preassembled insert into a fixed portion of the tap body, comprising the cartridge for adjusting and mixing the hot end cold water flows and all the gaskets required for sealing such insert into the tap body. In this taps, it is possible to turn the water outlet only and water is delivered from the cartridge to such outlet through ducts obtained in the material forming the tap body. The water then circulates in contact with the metal that makes up the tap body, with consequent degradation or alteration of its quality.

Moreover, over time, the top turning portion of these taps comprising the water outlet tends to oscillate, with consequent water leakage from the coupling to the fixed portion.

SUMMARY OF THE INVENTION

An object of the present finding is that of proposing a tap for single hole kitchen sinks wherein the water adjustment and mixing cartridge is arranged as close as possible to the outlet so that the water only circulates into the outlet itself, thereby minimising the contact with the metal of the tap body.

Another object of the finding is that of providing a tap with a new configuration and combination of elements that should allow obtaining a better functionality a higher reliability over time than current taps.

Such objects are achieved by a tap for single hole kitchen sinks comprising a top body arranged and turning on a bottom fixed and hollow body, wherein a water outlet extends from the top body, wherein the water adjustment and mixing cartridge is housed into a seat obtained into the top turning body at the water outlet and therefore directly connected to it, the cartridge being connected to the hot and cold water delivery ducts coming from the sink and passing through the bottom body. The cartridge is controlled by a lever located on top of the top body. The top body is integral with a union sleeve inserted and rotating into the bottom fixed body.

BRIEF DESCRIPTION OF THE DRAWINGS

Further features of the finding will appear more clearly from the following description, made with reference to the attached indicative and non-limiting drawings, wherein.

DESCRIPTION OF THE PREFERRED EMBODIMENT

Figure 1:
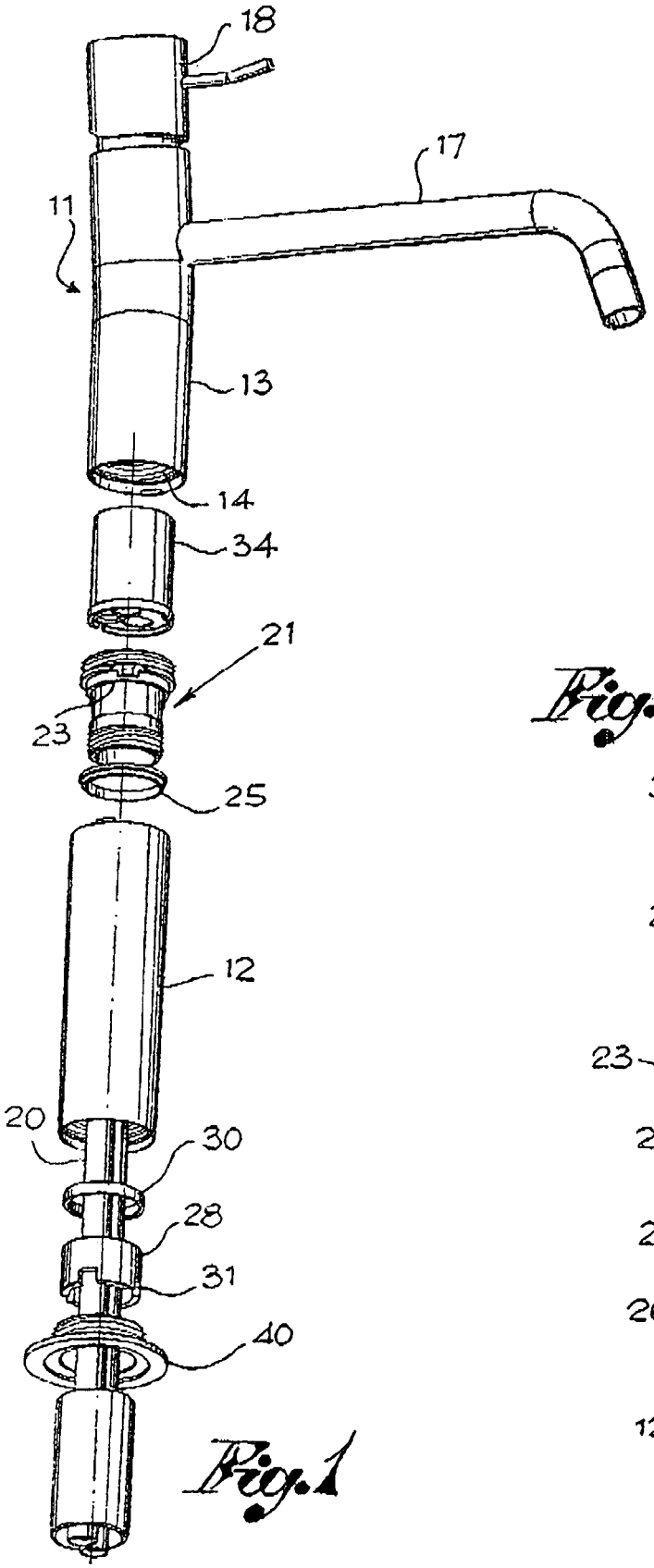
FIG. 1 shows an exploded perspective view of the elements making up the tap under discussion.
Figure 2:
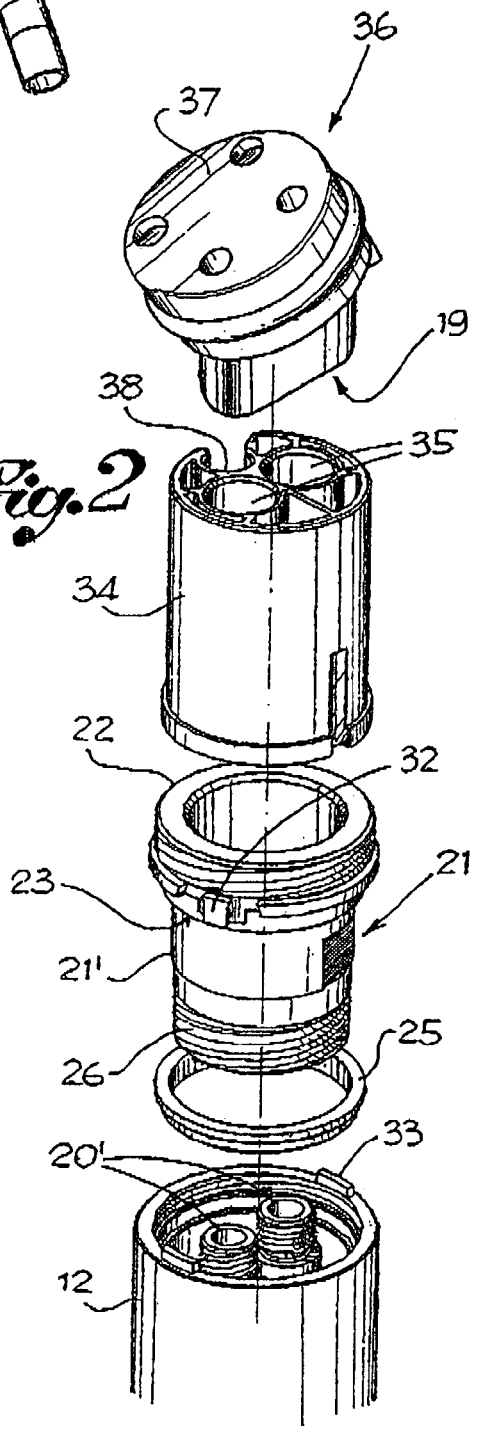
FIG. 2 shows an exploded enlarged perspective view of some of the tap elements.
Figure 3:
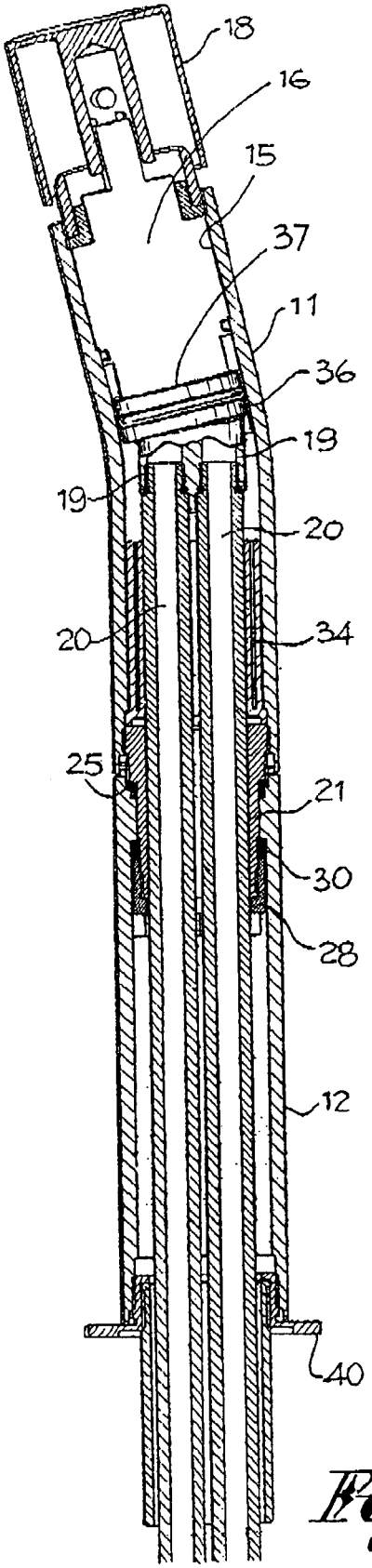
FIG. 3 shows the tap in axial section.
Figure 4:
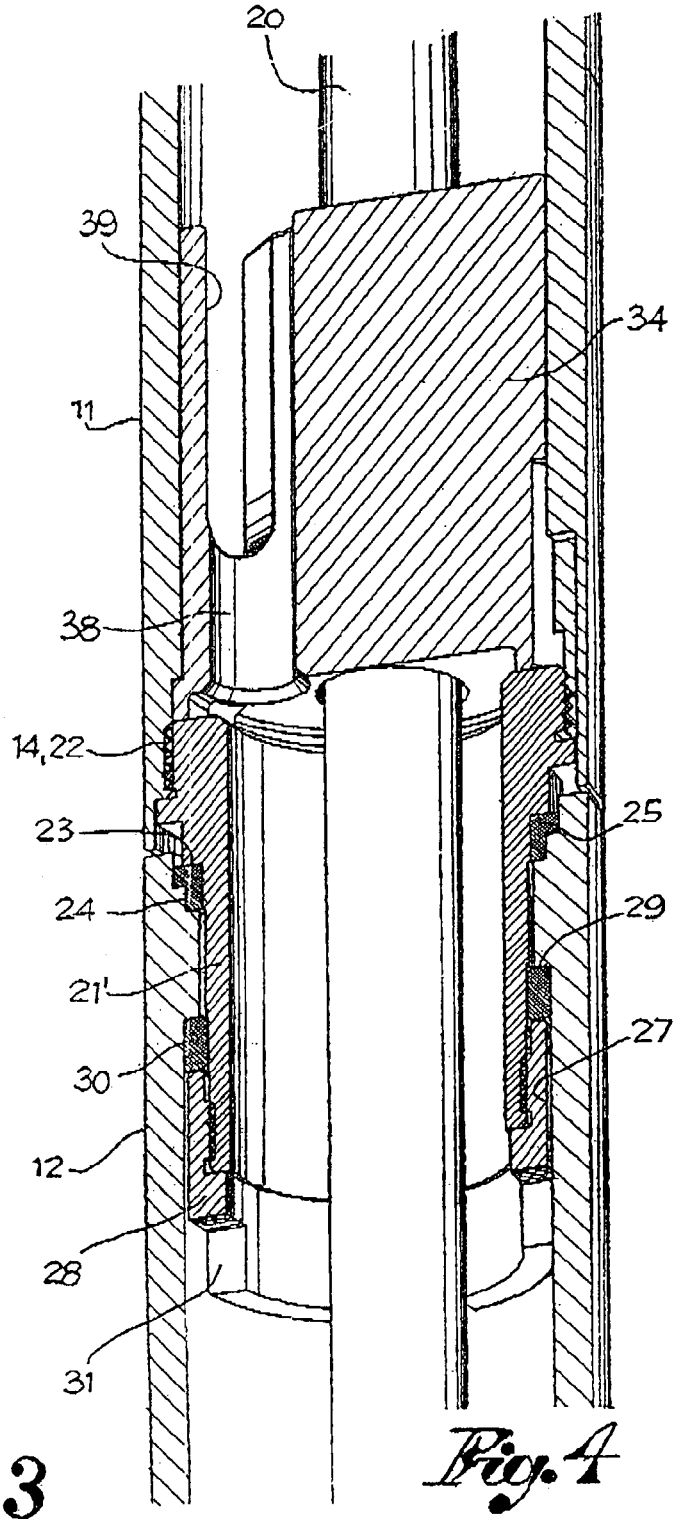
FIG. 4 shows an enlarged axial section of a portion of the tap.

The tap under discussion essentially exhibits a top body 11 rotating on a fixed bottom body 12 extending from the top of a kitchen sink.

Starting from the bottom, the top body 11 exhibits a hollow cylindrical portion 13 with an internally threaded portion 14 in the proximity of its opening facing the bottom body 12, a seat 15 for housing a conventional tap cartridge 16, a water outlet 17 communicating with the output passage of the cartridge 16, and a cartridge control lever 18 on top of the top body.

In the example shown, the top body 11 forms a curve above the hollow cylindrical portion 13 so that the axis of cartridge 16 is inclined to the bottom portion of the tap. To compensate such inclination, an insert 36 made of steel suitable for use in the food industry is inserted into the top body 11 below cartridge 16 for the communication of the hot and cold water gaps of the cartridge, not shown, whose inlets lay on an inclined plane, with the water delivery ducts 20 that have the same height. On its top side, such insert 36 exhibits an inclined surface for resting cartridge 16 and on its bottom side, it exhibits two threaded inlets 19, open on a horizontal plane, adapted for receiving and locking the top threaded ends 20' of ducts 20. It is evident that if the top body 11 is straight, insert 36 is not required anymore since ducts 20 can be directly screwed to the bottom of cartridge 16.

The tap also comprises a union sleeve 21 having a body 21' adapted for being inserted from top into the hollow bottom body 12 and an externally threaded neck 22 protruding from the top of the body 12 for screwing onto the threaded portion 14 of the top body 11. Such neck 22 with the body 21' of the sleeve define an annular undercut 23 resting on a corresponding step 24 obtained around the edge of the bottom body 12 of the tap with the interposition of a first sealing gasket 25.

Body 21' of sleeve 21 has such diameter as to delimit an interspace 27 with the inside wall of the bottom body 12 and on its bottom portion it exhibits an externally threaded portion 26 for screwing a threaded ring nut 28. In combination with an undercut 29 obtained in the inside wall of the bottom body 12, its top edge defines a seat for housing a second annular gasket 30. Once screwed to sleeve 21, the ring nut 28 constraints it to the bottom body 12, thereby preventing it from being pulled out from top.

In order to be screwed to the sleeve, the ring nut is provided with at least two diametrically opposed bottom notches 31 on which it is possible to act using a tool introduced from the bottom into the bottom body 12.

In practice, even though the top body 11 is sided to the bottom body 12, it does not directly rest on it but is constrained thereon by the union sleeve 21. The latter therefore allows the rotation of the top body 11, since it is integral with it, and at the same time since it is free to rotate into the bottom body 12 resting onto gaskets 25 and 30.

The rotation of the top body is also limited, for example at an angle of 140°, by the same sleeve 21, since it is provided with a pair of diametrically opposed overhangs 32 that extend radially from neck 22, below the threading, and which are adapted for intercepting corresponding teeth 33 obtained on the edge of the bottom body 12.

In order to facilitate the insertion and screwing of ducts 20 into holes 19 of insert 36, into the hollow cylindrical portion 13 of the latter it is possible to house a bushing 34 longitudinally crossed by through holes 35 for guiding ducts 20 and optionally, by a hole 38 for the passage of the pawl control bar. Such bar can be controlled by an actuation lever protruding from the tap through a longitudinal notch 39 obtained into bushing 33 and Into the top body 11.

The tap is completed by a ring nut 40 for fixing the top body 12 to the sink.

The invention claimed is:

1. A tap for a single hole kitchen sink comprising a top body having an internal seat;

a bottom fixed and hollow body, wherein the top body is arranged for turning on the bottom body;

a water outlet extending from the top body;

hot and cold water delivery ducts coming from the sink and passing through the bottom body;

a lever located on top of the top body;

a water adjustment and mixing cartridge housed in the seat of the top body, the cartridge being directly connected to the outlet and being controlled by the lever;

a union sleeve, integral with the top body inserted into and rotatable with respect to the bottom body, wherein the sleeve comprises a body adapted to be inserted from above into the bottom body;

a ring nut adapted to be inserted into the bottom body and adapted to be connected to the sleeve for axially locking the sleeve to the bottom body.

2. A tap according to claim 1, wherein the top body has a threaded portion and wherein the body of the sleeve has an externally threaded neck protruding from the top of the bottom body for screwing onto the threaded portion of the top body.

3. A tap according to claim 2, wherein the tap comprises a first sealing gasket and wherein the neck and the body of the sleeve define an annular undercut into which the first sealing gasket is housed.

4. A tap according to claim 1, wherein the tap comprises a second annular sealing gasket and wherein the body of the sleeve has such diameter as to delimit an interspace with the bottom body, said second gasket being housed into the interspace.

5. A tap according to claim 4, wherein the second gasket is biased by the ring nut.

6. A tap according to claim 5, wherein the ring nut is provided with at least two diametrically opposed bottom notches in which it is possible to introduce a screwing tool from the bottom into the bottom body.

7. A tap according to claim 1, wherein the bottom body presents teeth and wherein the sleeve is provided with a pair of diametrically opposed overhangs adapted for engaging into the corresponding teeth for limiting the rotation of the top body.

8. A tap according claim 1, wherein the tap comprises a bushing housed into the top body in order to facilitate the connection of the ducts to the cartridge, the bushing being longitudinally crossed by thorough holes.

9. A tap according to claim 8, wherein the bushing is also crossed by a hole for the passage of a pawl control actuation bar, such bar being connected and controlled by a lever protruding from the tap through aligned longitudinal notches obtained into said bushing and into the top body.

10. A tap according to claim 1, wherein the portion of the top body in which the cartridge is housed is inclined with respect to the axis of the bottom body and therefore to the ducts and wherein the tap comprises an angular insert arranged between the cartridge and the ducts, said insert being crossed by two water passage gaps and exhibiting a top inclined surface for resting the cartridge and two bottom threaded inlets open in a horizontal plane for receiving and locking top threaded ends of the ducts.

11. A tap according to claim 10, wherein said insert is made of steel for use in the food industry.

* * * * *